US008115386B2

(12) United States Patent
Shimoi et al.

(10) Patent No.: US 8,115,386 B2
(45) Date of Patent: Feb. 14, 2012

(54) PHOTOMULTIPLIER TUBE

(75) Inventors: Hideki Shimoi, Hamamatsu (JP); Hitoshi Kishita, Hamamatsu (JP); Tsuyoshi Kodama, Hamamatsu (JP); Hiroyuki Kyushima, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 3 days.

(21) Appl. No.: 12/709,682

(22) Filed: Feb. 22, 2010

(65) Prior Publication Data

US 2010/0213837 A1 Aug. 26, 2010

(30) Foreign Application Priority Data

Feb. 25, 2009 (JP) ..... P2009-042393

(51) Int. Cl.
*H01J 43/18* (2006.01)

(52) U.S. Cl. ..... 313/533; 313/103 CM; 313/105 CM; 313/535

(58) Field of Classification Search ..... 313/533–536, 313/537, 103 CM, 105 CM
See application file for complete search history.

(56) References Cited

U.S. PATENT DOCUMENTS

| | | | | |
|---|---|---|---|---|
| 3,225,239 | A | 12/1965 | Thompson | |
| 4,115,719 | A * | 9/1978 | Catanese et al. | 313/105 R |
| 5,264,693 | A | 11/1993 | Shimabukuro et al. | |
| 5,568,013 | A | 10/1996 | Then et al. | |
| 6,384,519 | B1 * | 5/2002 | Beetz et al. | 313/103 CM |
| 7,049,747 | B1 | 5/2006 | Goodberlet et al. | |
| 7,294,954 | B2 | 11/2007 | Syms | |
| 2007/0194713 | A1 * | 8/2007 | Kyushima et al. | 313/532 |
| 2009/0224666 | A1 | 9/2009 | Kyushima et al. | |

FOREIGN PATENT DOCUMENTS

| | | |
|---|---|---|
| GB | 503211 | 4/1939 |
| JP | 43-443 | 1/1943 |
| JP | 2007048712 A * | 2/2007 |

* cited by examiner

*Primary Examiner* — Karabi Guharay
*Assistant Examiner* — Michael Santonocito
(74) *Attorney, Agent, or Firm* — Drinker Biddle & Reath LLP

(57) ABSTRACT

Electrons are prevented from being made incident onto an insulation part of a casing between dynodes to improve a withstand voltage. The photomultiplier tube 1 is a photomultiplier tube which is provided with substrates 20, 40 arranged so as to oppose each other, with the respective opposing surfaces 20*a*, 40*a* made with an insulating material, a substrate 30 constituting a casing together with the substrates 20, 40, dynodes 31*a* to 31*j* arrayed on an opposing surface 40*a* on the substrate 40 so as to be spaced away sequentially from a first end side to a second end side, a photocathode 22 installed so as to be spaced away from the dynode 31*a* to the first end side, and an anode part 32 installed so as to be spaced away from the dynode 31*j* to the second end side, in which the opposing surface 20*a* of the substrate 20 is formed so as to cover the dynodes 31*a* to 31*j*, and a plurality of conductive layers 21*a* to 21*j* set equal in potential to dynodes 31*a* to 31*j* which are electrically independent from each other are installed at sites opposing individually the dynodes 31*a* to 31*j* on the opposing surface 20*a*.

13 Claims, 9 Drawing Sheets

PHOTOMULTIPLIER TUBE

BACKGROUND OF THE INVENTION

1. Field of the Invention

The present invention relates to a photomultiplier tube for detecting incident light from outside.

2. Related Background Art

Conventionally, compact photomultiplier tubes by utilization of fine processing technology have been developed. For example, a flat surface-type photomultiplier tube which is arranged with a photocathode, dynodes and an anode on a translucent insulating substrate is known (refer to Patent Document 1 given below). The above-described structure makes it possible to detect weak light at a high degree of reliability and also downsize a device.

Patent Document 1: U.S. Pat. No. 5,264,693

SUMMARY OF THE INVENTION

However, in the above-described conventional photomultiplier tubes, individual stages of dynodes are arranged on an insulating substrate of a casing constituted with the insulating substrate and cap members, thereby giving such a structure that multiplied electrons, the orbit of which is widened as the electrons pass between secondary electron surfaces of these individual stages of dynodes, are easily made incident onto the insulating substrate of the casing. This tendency becomes apparent when the casing is downsized for refinement. Therefore, there has been a case where the casing is electrically charged to result in a decrease in withstand voltage.

Under these circumstances, the present invention has been made in view of the above problem, an object of which is to provide a photomultiplier tube capable of preventing electrons from being made incident onto an insulation part of a casing between dynodes to improve a withstand voltage.

In order to solve the above problem, the photomultiplier tube of the present invention is a photomultiplier tube which is provided with a first substrate and a second substrate which are arranged so as to oppose each other, with the respective opposing surfaces made with an insulating material, a side wall part which constitutes a casing together with the first and the second substrates, a plurality of stages of electron multiplying parts which are arrayed on the opposing surface of the first substrate so as to be spaced away sequentially from a first end side to a second end side and each of which has a secondary electron surface extending in a direction intersecting with the opposing surface, a photocathode which is installed on the first end side so as to be spaced away from the electron multiplying part, converting incident light from outside to photoelectrons to emit the photoelectrons, and an anode part which is installed on the second end side so as to be spaced away from the electron multiplying part to take out electrons multiplied by the electron multiplying parts as a signal, in which the opposing surface of the second substrate is formed so as to cover a plurality of electron multiplying parts, and a plurality of conductive members which are electrically independent from each other and set equal in potential to the individually opposing electron multiplying parts are installed along the opposing surface at sites opposing individually the plurality of electron multiplying parts on the opposing surface.

According to the above-described photomultiplier tube, incident light is made incident on the photocathode, by which the light is converted to photoelectrons, these photoelectrons are made incident sequentially into a plurality of stages of electron multiplying parts on the opposing surface of the first substrate and multiplied accordingly, and the thus multiplied electrons are taken out from the anode part as an electric signal. In this instance, a plurality of conductive members equal in potential to each of the opposing electron multiplying parts are installed so as to be electrically independent from each other at sites opposing each of the plurality of stages of electron multiplying parts on the opposing surface of the second substrate opposing the first substrate. Therefore, electrons passing between the plurality of stages of electron multiplying parts are prevented from being made incident onto the opposing surface of the second substrate. It is, thereby, possible to prevent a decrease in withstand voltage due to electric charge of the surface of the substrate.

It is preferable that the plurality of conductive members are formed in such a manner that each of the end parts thereof on the second end side projects to the second end side more than each of the end parts of the opposing electron multiplying parts on the second end side. In this instance, electrons passing between the stages of electron multiplying parts can be reliably prevented from being made incident onto the opposing surface of the second substrate.

It is also preferable that the plurality of conductive members are formed in such a manner that each of the end parts thereof on the first end side is positioned to the second end side more than each of the end parts of the opposing electron multiplying parts on the first end side. According to the above constitution, a distance between adjacent conductive members is secured, thus making it possible to suppress leakage current between the conductive members and also increase a withstand voltage.

Further, it is also preferable that the plurality of conductive members are connected to a plurality of power feeding parts installed on the second substrate and the plurality of electron multiplying parts are electrically connected to the individually opposing conductive members and powered from the plurality of power feeding parts. In this instance, the electron multiplying parts are powered via conductive members, thus simplifying a structure in which the conductive members are set equal in potential to the electron multiplying parts.

DESCRIPTION OF THE PREFERRED EMBODIMENTS

Hereinafter, a detailed description will be given for preferred embodiments of the photomultiplier tube related to the present invention by referring to drawings. In addition, in describing the drawings, the same or corresponding parts will be given the same numeral references to omit overlapping description.

Figure 1:
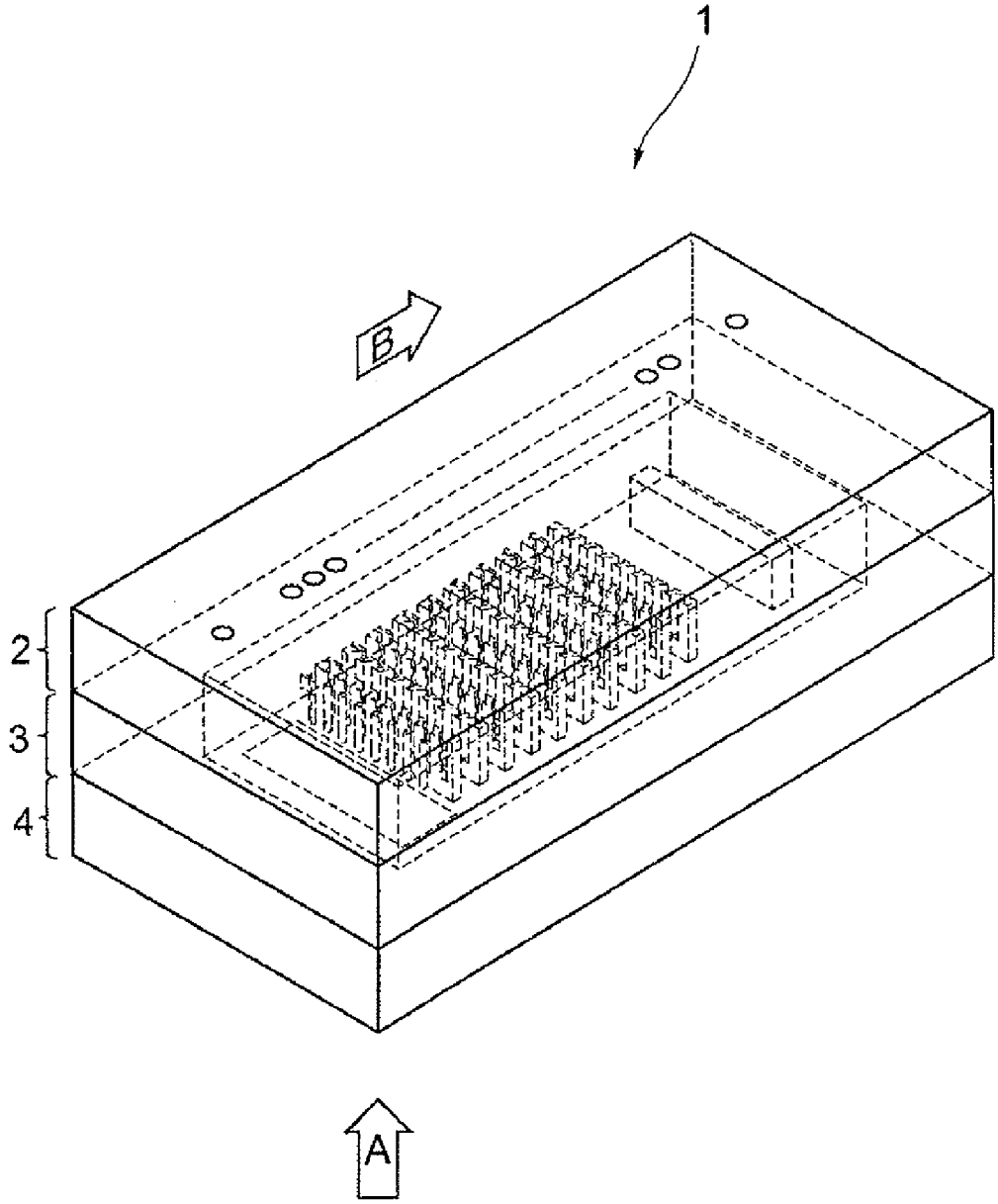
FIG. 1 is a perspective view of a photomultiplier tube which is related to one preferred embodiment of the present invention.
Figure 2:
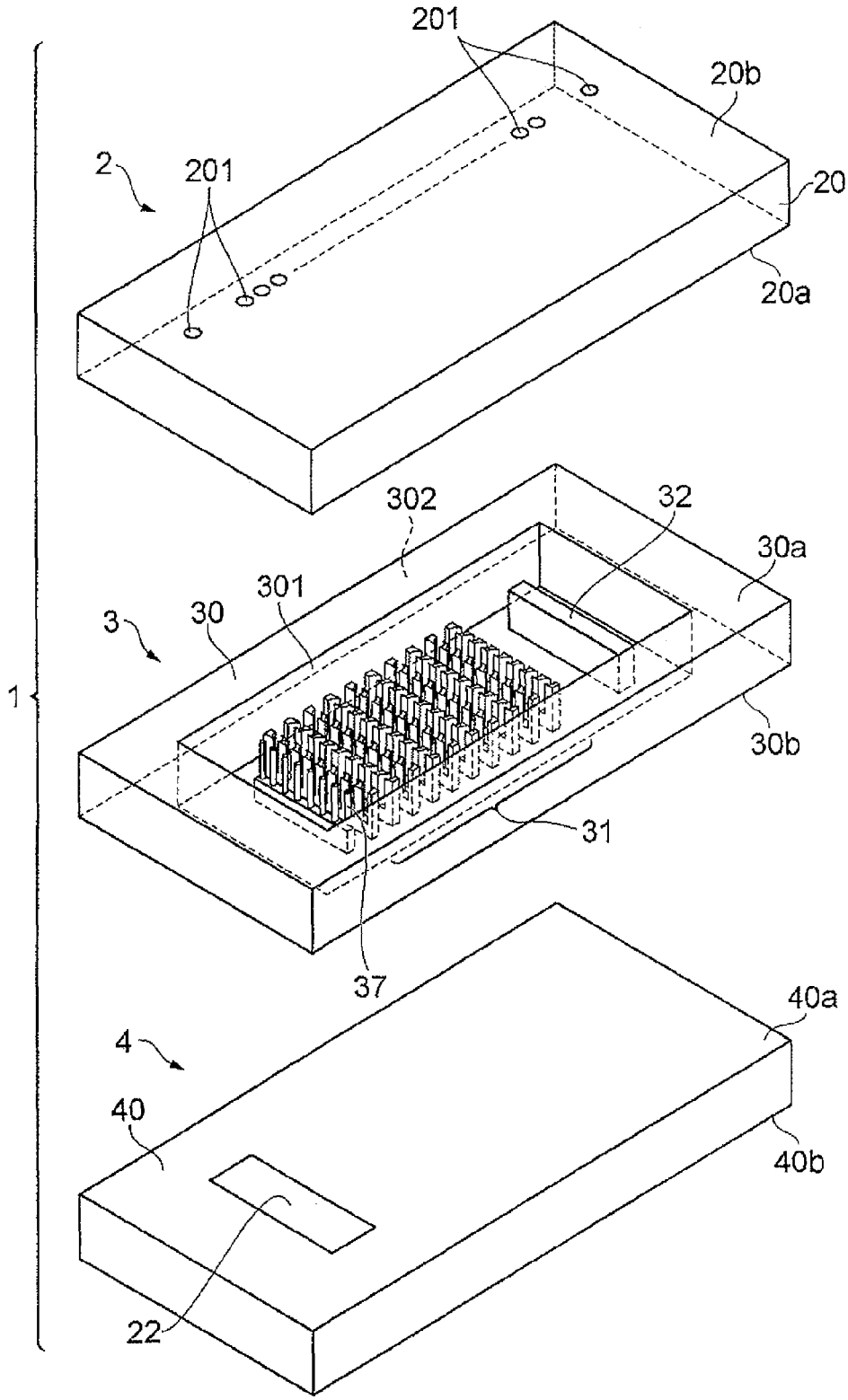
FIG. 2 is an exploded perspective view of the photomultiplier tube given in FIG. 1.

FIG. 1 is a perspective view of a photomultiplier tube 1 related to one preferred embodiment of the present invention. FIG. 2 is an exploded perspective view of the photomultiplier tube 1 shown in FIG. 1.

The photomultiplier tube 1 shown in FIG. 1 is a photomultiplier tube having a transmission-type photocathode and provided with a casing constituted with an upper frame 2 (a second substrate), a side-wall frame 3 (a side wall part), and a lower frame 4 (a first substrate) which is constituted so as to oppose the upper frame 2, with the side-wall frame 3 kept therebetween. The photomultiplier tube 1 is an electron tube such that a light incident direction onto the photocathode intersects with a direction at which electrons are multiplied at the electron multiplying part. Specifically, when light is made incident from a direction indicated by the arrow A in FIG. 1, photoelectrons emitted from the photocathode are made incident onto the electron multiplying part, thereby secondary electrons are subject to cascade amplification in a direction indicated by the arrow B to take out a signal from the anode part.

In addition, in the following description, the upstream side of an electron multiplying channel (the side of the photocathode) along a direction at which electrons are multiplied is given as "a first end side," while the downstream side (the side of the anode part) is given as "a second end side." Further, a detailed description will be given for individual constituents of the photomultiplier tube 1.

As shown in FIG. 2, the upper frame 2 is constituted with a wiring substrate 20 made mainly with rectangular flat-plate like insulating ceramics as a base material. As the above-described wiring substrate, there is used a multilayer wiring substrate such as LTCC (low temperature co-fired ceramics) in which microscopic wiring can be designed and also wiring patterns on front-back both sides can be freely designed. The wiring substrate 20 is provided on a main surface 20*b* thereof with a plurality of conductive terminals (power feeding parts) 201 electrically connected to a photocathode 22 to be described later, focusing electrodes 37, an electron multiplying part 31, and the anode part 32, to supply power from outside and take out a signal. These conductive terminals 201 are mutually connected to conductive terminals (not illustrated) on an insulating opposing surface 20*a* which opposes the main surface 20*b* inside the wiring substrate 20, by which these conductive terminals are connected to the photocathode 22, the focusing electrodes 37, the electron multiplying part 31 and the anode part 32. In addition, in FIG. 1 and FIG. 2, the conductive terminals 201 are described by omitting some of them for simplifying the drawings. Further, the upper frame 2 is not limited to a multilayer wiring substrate having the conductive terminals 201 but may include a plate-like member made with an insulating material such as a glass substrate on which conductive terminals for supplying power from outside and taking out a signal are installed so as to penetrate. In addition, where the photocathode 22 is equal in potential to the focusing electrodes 37, there may be used common conductive terminals.

The side-wall frame 3 is constituted with a rectangular flat-plate like silicon substrate 30 as a base material. A penetration part 301 enclosed by a frame-like side wall part 302 is formed from a main surface 30*a* of the silicon substrate 30 toward an opposing surface 30*b* thereto. The penetration part 301 is provided with a rectangular opening and an outer periphery of which is formed so as to run along the outer periphery of the silicon substrate 30.

Inside the penetration part 301, the focusing electrodes 37, the electron multiplying part 31 and the anode part 32 are formed from the first end side to the second end side. These focusing electrodes 37, the electron multiplying part 31 and the anode part 32 are formed by processing the silicon substrate 30 according to RIE (reactive ion etching) or others and made mainly with silicon. The focusing electrodes 37 are electrodes for guiding photoelectrons emitted from the photocathode 22 to be described later into the electron multiplying part 31 and installed between the photocathode 22 and the electron multiplying part 31. The electron multiplying part 31 is constituted with N stages (N denotes an integer of two or more) of dynodes (electron multiplying parts) set different in potential along a direction at which electrons are multiplied from the photocathode 22 to the anode part 32 and provided with a plurality of electron multiplying channels (channels) at each stage. The anode part 32 is arranged at a position holding the electron multiplying part 31 together with the photocathode 22. The focusing electrodes 37, the electron multiplying part 31 and the anode part 32 are respectively connected to the lower frame 4 by anode joining, diffusion joining and joining using a sealing material such as a low-melting-point metal (for example, indium), by which they are arranged on the lower frame 4 two-dimensionally (the details will be described later). In addition, inside the penetration part 301, columnar parts (not illustrated) which electrically connect the photocathode 22 with conductive terminals 201 for the photocathode 22 are also formed. Further, the electron multiplying part 31, the focusing electrodes 37 and the anode part 32 are individually connected to the corresponding conductive terminals 201 inside the penetration part 301 (the details will be described later) and set in a predetermined potential via the conductive terminals 201. For example, where dynodes are constituted at ten stages, a voltage of 100 to 1000V is applied in incremental steps at every 100V intervals to the photocathode 22 at ten stages of dynodes, and a voltage of 1100V is applied to the photocathode 22 at the anode part 32.

The lower frame 4 is constituted with a rectangular flat-plate like glass substrate 40 as a base material. The glass substrate 40 forms an opposing surface 40*a* which opposes the opposing surface 20*a* of the wiring substrate 20 by glass which is an insulating material. The photocathode 22 which is a transmission-type photocathode is formed at a site opposing the penetration part 301 of the side-wall frame 3 on the opposing surface 40*a* (a site other than a region joining with the side wall part 302) and at the end part opposite to the side of the anode part 32.

Figure 3:
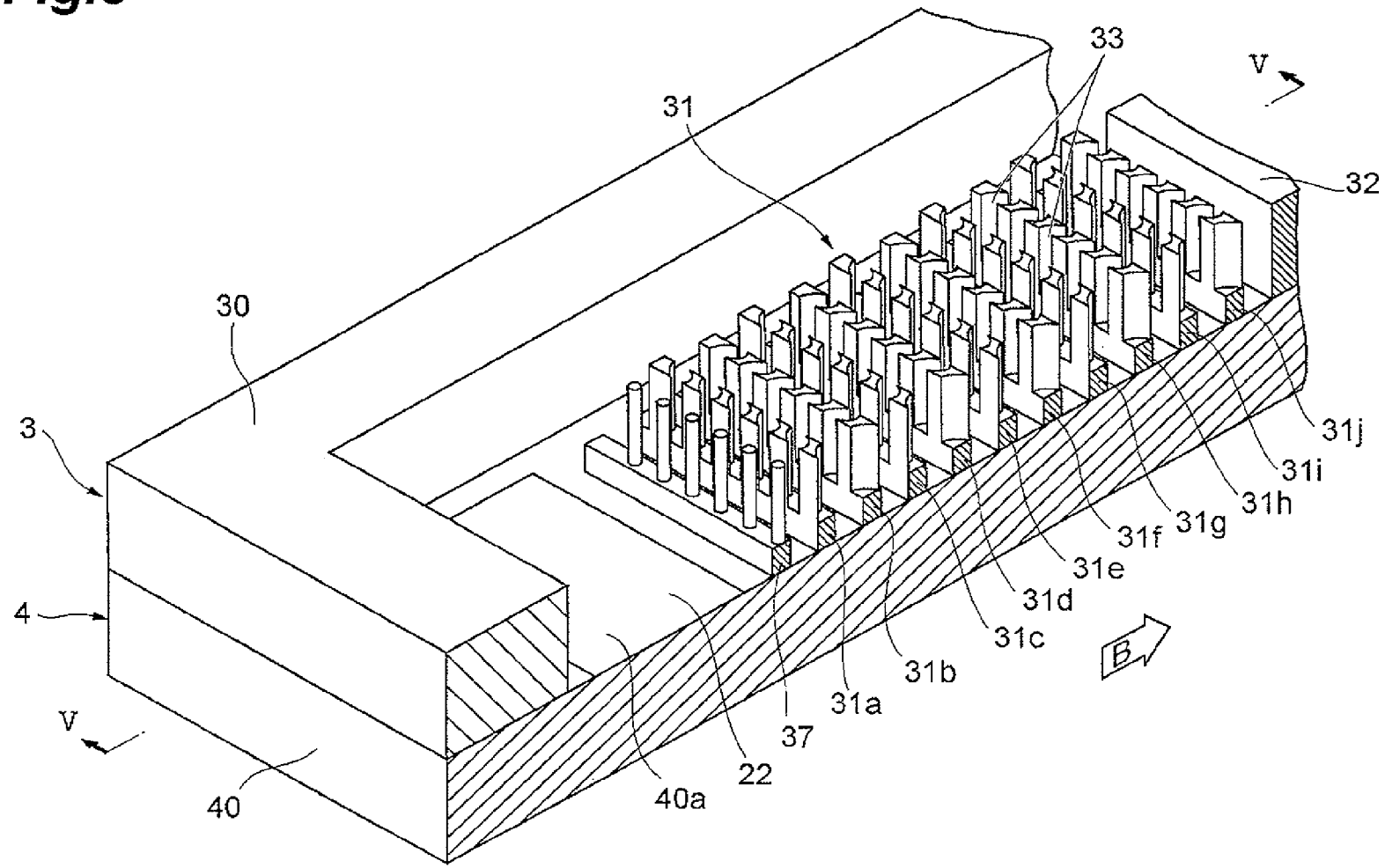
FIG. 3 is a partially broken perspective view showing an internal structure of the photomultiplier tube shown in FIG. 1, when viewed from an upper frame.
Figure 4:
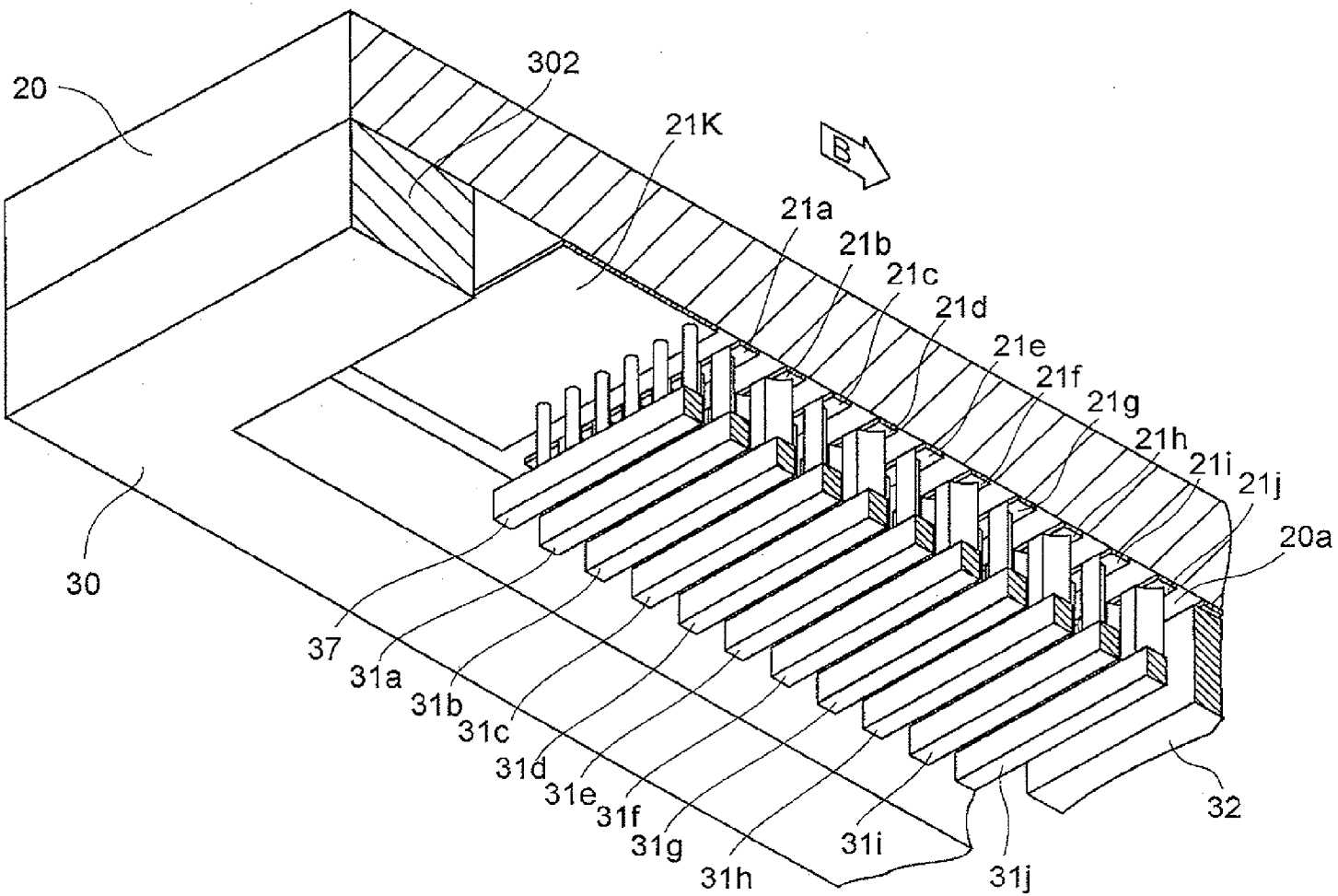
FIG. 4 is a partially broken perspective view showing an internal structure of the photomultiplier tube shown in FIG. 1, when viewed from a lower frame.

Next, the internal structure of the photomultiplier tube 1 will be described in more detail by referring to FIG. 3 and FIG. 4. FIG. 3 is a partially broken perspective view showing the internal structure of the photomultiplier tube 1, when viewed from the upper frame 2. FIG. 4 is a partially broken perspective view showing the internal structure, of the photomultiplier tube 1, when viewed from the lower frame 4.

As shown in FIG. 3, the electron multiplying part 31 is constituted with a plurality of stages of dynodes arrayed so as to be spaced away sequentially from the first end side on the opposing surface 40*a* to the second end side (in a direction indicated by the arrow B, that is, a direction at which electrons are multiplied). The number of stages of dynodes is not limited to a specific number of stages, however, FIG. 3 shows a case where the electron multiplying part is constituted with a $1^{st}$ stage dynode to a $10^{th}$ stage dynode 31*a* to 31*j*. Each of the plurality of stages of dynodes 31*a* to 31*j* is provided with a secondary electron surface 33 extending in a direction approximately orthogonal to the opposing surface 40*a*.

The photocathode 22 is installed so as to be spaced away from the $1^{st}$ stage dynode 31*a* to the first end side on the opposing surface 40*a* behind the focusing electrode 37, and the photocathode 22 is formed on the opposing surface 40*a* of the glass substrate 40 as a transmission-type photocathode. When incident light transmitted from outside through the glass substrate 40, which is the lower frame 4, arrives at the photocathode 22, photoelectrons corresponding to the incident light are emitted, and the photoelectrons are guided into the electron multiplying part 31 by the focusing electrodes 37.

The anode part 32 is installed so as to be spaced away from the tenth dynode 31*j* to the second end side on the opposing surface 40*a*, and the anode part 32 is an electrode for taking out electrons which are multiplied by the electron multiplying part 31 in a direction indicated by the arrow B as an electric signal.

Further, as shown in FIG. 4, the wiring substrate 20 is arranged so as to cover the focusing electrodes 37, the electron multiplying part 31 and the leading end of the anode part 32 by the opposing surface 20*a* thereof. A plurality of conductive layers (conductive members) 21*a* to 21*l* which are electrically independent from each other are formed at a range on the opposing surface 20*a* enclosed by the side wall part 302. The conductive layers 21*a* to 21*l* are individually formed in a band shape along a direction substantially perpendicular to a direction at which the dynodes are arrayed (a direction along the arrow B shown in FIG. 4) so as to run along a direction at which the dynodes 31*a* to 31*j* extend at sites opposing leading ends of a plurality of stages of the dynodes 31*a* to 31*j*. Still further, the conductive layers 21*j*, 21*k* are individually formed in a band shape along a direction substantially perpendicular to a direction at which the dynodes are arrayed so as to run along a direction at which the anode part 32 extends and a direction at which the focusing electrodes 37 are arrayed at sites opposing the leading end of the anode part 32 and the leading end of focusing electrodes 37.

Figure 5:
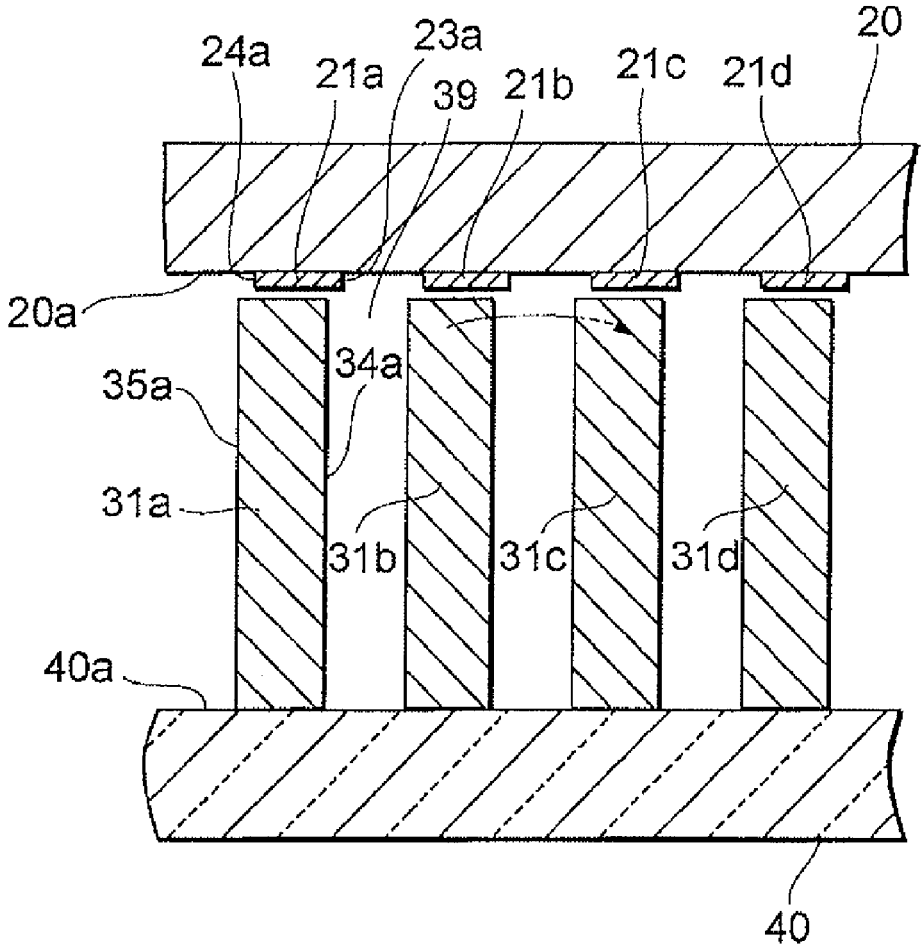
FIG. 5 is a partially enlarged sectional view along the line V to V in a state that the upper frame is attached to electron multiplying parts and the lower frame shown in FIG. 3.

FIG. 5 is a partially enlarged sectional view along the line V to V in a state that the upper frame is attached to the electron multiplying part and the lower frame shown in FIG. 3 and a section view of the glass substrate 40 in the thickness direction and in a direction at which electrons are multiplied. The conductive layer 21*a* formed on the opposing surface 20*a* of the wiring substrate 20 is arranged in such a manner that an end part 23*a* on the second end side in a direction at which electrons are multiplied projects to the second end side more than an end part 34*a* of the dynode 31*a* on the second end side, that is, projecting to the dynode 31*b* which is a subsequent stage, and an end part 24*a* on the first end side is positioned to the second end side more than an end part 35*a* of the dynode 31*a* on the first end side, that is, being included in a range opposing the leading end of the dynode 31*a*. In other words, the conductive layer 21*a* deviates from the range opposing the leading end of the dynode 31*a* to a direction at which electrons are multiplied and is formed so as to be astride the range opposing the leading end of the dynode 31*a* and a range opposing a space 39 between the dynode 31*a* and the dynode 31*b* which is a subsequent stage. Similarly, the conductive layers 21*b* to 21*j* are formed so as to deviate from a range opposing the leading ends of the dynodes 31*b* to 31*j* to a direction at which electrons are multiplied.

For example, where the thickness of the upper frame 2, that of the side-wall frame 3 and that of the lower frame 4 along a direction at which light is made incident are respectively 0.5 mm, 1.0 mm and 0.5 mm, the thickness of a sealing part for sealing the upper frame 2 and the side-wall frame 3 under vacuum in a direction at which light is made incident is 0.05 to 0.1 mm and the width of dynodes 31*a* to 31*j* which constitute the electron multiplying part 31 along a direction at which electrons are multiplied is about 0.2 mm, the conductive layers 21*a* to 21*j* are set so as to be about 0.2 mm in width along a direction at which electrons are multiplied and about 0.02 mm in membrane thickness, and deviations from the end parts of the dynode 31*a* to 31*j* on the first and second end side are both set to be 0.05 mm. In this instance, the width of each of the dynodes 31*a* to 31*j* along a direction at which electrons are multiplied can be adjusted in a range from about 0.2 to about 0.5 mm, and the width of each of the conductive layers 21*a* to 21*j* along a direction at which electrons are multiplied can also be adjusted accordingly.

Figure 6:
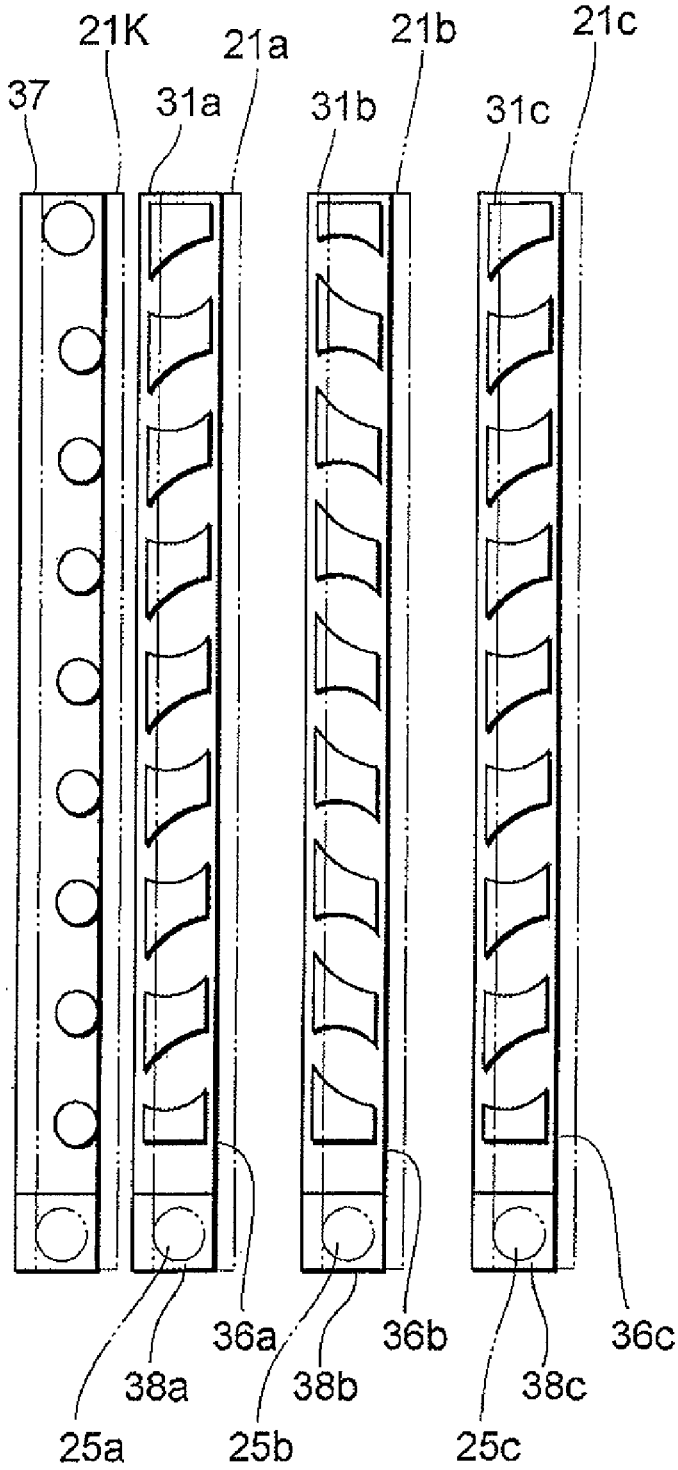
FIG. 6 is a perspective diagram showing focusing electrodes and electron multiplying parts in FIG. 3, when viewed from the upper frame.

FIG. 6 is a perspective diagram which shows the focusing electrode 37 and the electron multiplying part 31, when viewed from the upper frame. As shown in the drawing, the $1^{st}$ stage to the $3^{rd}$ stage dynodes 31*a*, 31*b*, 31*c* are respectively provided with square-column like conductor parts 38*a*, 38*b*, 38*c* which extend along a direction at which the dynodes 31*a*, 31*b*, 31*c* extend from base parts 36*a*, 36*b*, 36*c*, which are plate-like parts at which column-like electrode parts having secondary electron surfaces 33 are erected, and which act as fixing parts to the glass substrate 40 and are also electrically integrated with column-like electrode parts. These conductor parts 38*a*, 38*b*, 38*c* are electrically connected respectively to the conductive layers 21*a*, 21*b*, 21*c*, thereby the dynodes 31*a*, 31*b*, 31*c* are set equal in potential respectively to the conductive layers 21*a*, 21*b*, 21*c*. More specifically, conductive raised parts 25*a*, 25*b*, 25*c* which project to the leading ends of the conductor parts 38*a*, 38*b*, 38*c* are installed respectively at sites opposing the conductor parts 38*a*, 38*b*, 38*c* at the conductive layers 21*a*, 21*b*, 21*c* on the opposing surface 20*a*. And, the conductor parts 38*a*, 38*b*, 38*c* are respectively in contact with the raised parts 25*a*, 25*b*, 25*c*, by which the dynodes 31*a*, 31*b*, 31*c* are electrically connected to the conductive layers 21*a*, 21*b*, 21*c*. Further, these conductive layers 21*a*, 21*b*, 21*c* are electrically connected to the conductive terminals 201 by wiring inside the wiring substrate 20 (refer to FIG. 2), and the dynodes 31*a*, 31*b*, 31*c* are respectively powered from the conductive terminals 201 via the raised parts 25*a*, 25*b*, 25*c* and the conductive layers 21*a*, 21*b*, 21*c*. Still further, the $4^{th}$ stage to the $10^{th}$ stage dynodes 31*d* to 31*j*, the focusing electrode 37 and the anode part 32 are also similar in connection constitution and respectively powered from the conductive terminals 201 via the conductive layers 21*d* to 21*l* and set equal in potential to the conductive layers 21*d* to 21*l*.

Figure 9:
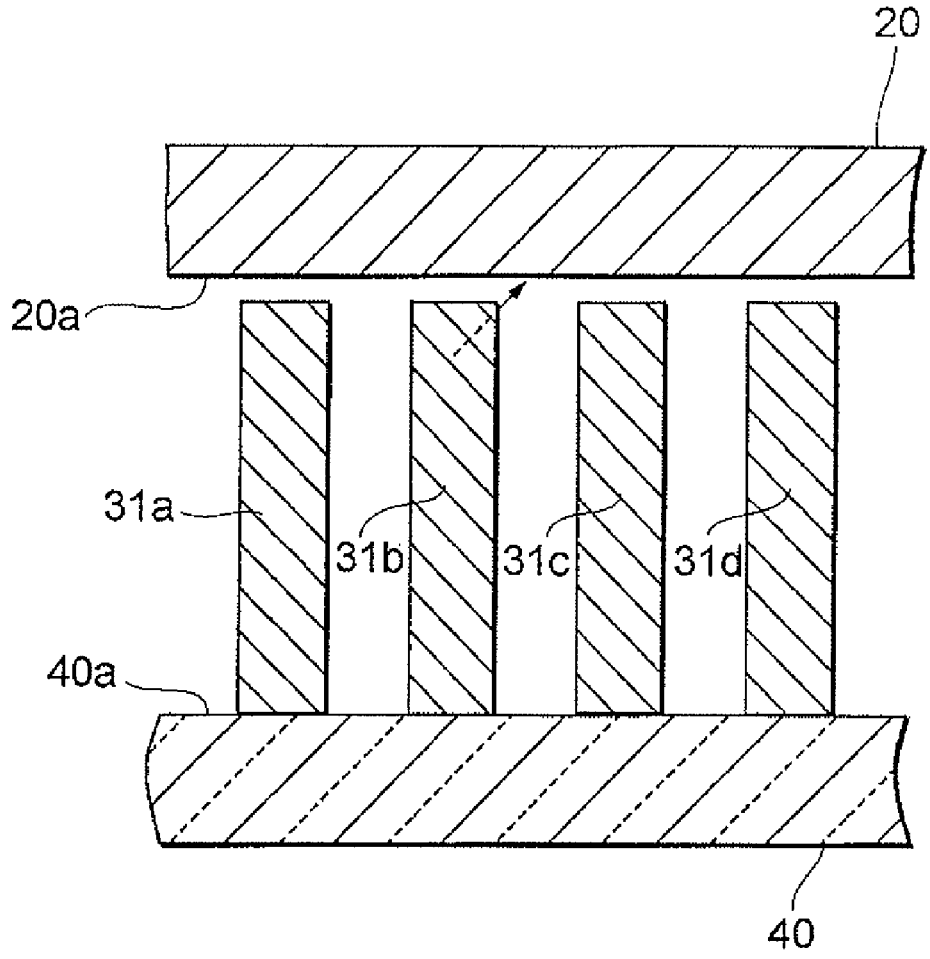
FIG. 9 is a partially enlarged sectional view showing a comparative example of the electron multiplying parts, the lower frame and the upper frame shown in FIG. 5.

According to the above described photomultiplier tube 1, incident light is made incident onto the photocathode 22, thereby converted to photoelectrons, and the photoelectrons are multiplied by being made incident into a plurality of stages of electron multiplying parts 31 on the glass substrate 40, and the thus multiplied electrons are taken out as an electric signal from the anode part 32. In this instance, on the opposing surface 20*a* of the upper frame 2 which opposes the lower frame 4, the plurality of conductive layers 21*a* to 21*j* equal in potential respectively to the dynodes 31*a* to 31*j* are installed at sites opposing the respective leading ends of a plurality of stages of dynodes 31*a* to 31*j*. It is, therefore, possible to prevent electrons passing between secondary electron surfaces 33 of the plurality of stages of dynodes 31*a* to 31*j* from being made incident onto the opposing surface 20*a* of the upper frame 2. Thereby, it is possible to prevent a decrease in withstand voltage due to electric charge of the surface of the substrate. For example, where no conductive layer is installed on the opposing surface 20*a* of the wiring substrate 20 (FIG. 9), when the orbit of electrons passing between dynodes deviates to the opposing surface 20*a* from a direction at which electrons are multiplied, the thus multiplied electrons are made incident onto an insulated surface to cause electric charge, which can be responsible for poor withstand voltage and noise defect resulting from emission. On the other hand, where a conductive layer is installed (FIG. 5), when the orbit of electrons deviates to the opposing surface 20*a* from a direction at which electrons are multiplied, electrons are pushed back to the opposing surface 40*a* of the glass substrate 40, and there is a decrease in area at which the multiplied electrons are made incident onto the insulated surface. Thus, the above problem is not found. Further, the multiplied electrons are prevented from being made incident, thus making it possible to suppress loss of the multiplied electrons and improve electron multiplying efficiency.

Further, in the conductive layers 21*a* to 21*j* installed on the wiring substrate 20, each of the end parts thereof on the second end side projects to subsequent stages of the dynodes 31*a* to 31*j* (or the side of the anode part 32) and deviates to the second end side. It is, thereby, possible to more reliably prevent electrons passing between the stages of dynode 31*a* to 31*j* from being made incident onto the opposing surface 20*a* of the upper frame 2.

Still further, in the conductive layers 21*a* to 21*j*, each of the end parts thereof on the first end side deviates to the second end side with respect to the dynodes 31*a* to 31*j* and is included in a range opposing the leading ends of the dynodes. It is, thereby, possible to secure each distance between adjacent conductive layers 21*a* to 21*j*, to suppress leakage current between the conductive layers and also to increase a withstand voltage to a greater extent.

In addition, the plurality of conductive layers 21*a* to 21*j* are set equal in potential to the opposing dynodes 31*a* to 31*j*. If the conductive layers are set lower in potential than the opposing dynodes, a force which pushes back electrons will be increased but multiplication efficiency of electrons by secondary electron surfaces will be decreased. On the other hand, if they are set equal in potential, it is possible to prevent electrons from being made incident onto the substrate surface and also keep the multiplication efficiency of electrons. Further, the dynodes 31*a* to 31*j* are allowed to be powered via the conductive layers 21*a* to 21*j*, by which a structure can be made simple where the conductive layers 21*a* to 21*j* are set equal in potential to the dynodes.

In addition, the present invention shall not be limited to the above described embodiments. For example, the width of a conductive layer formed on the wiring substrate 20 along a direction at which electrons are multiplied may be modified in the following manner.

Figure 7:
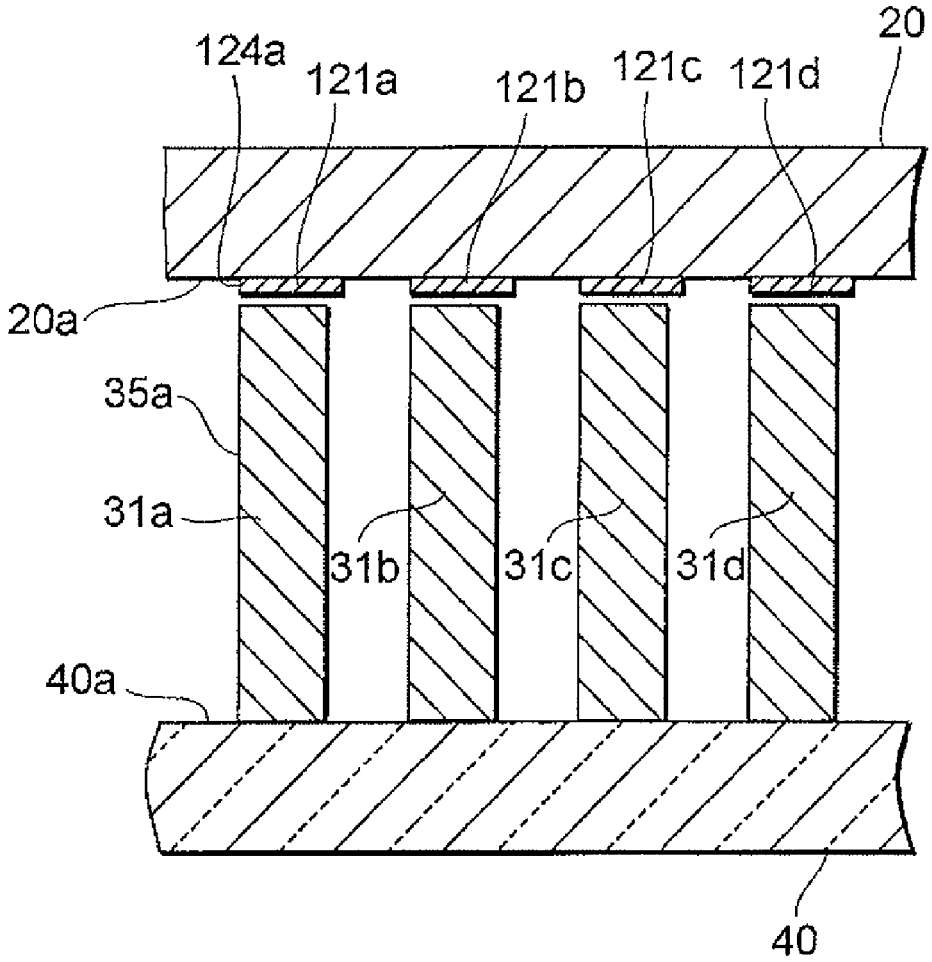
FIG. 7 is a partially enlarged sectional view showing a modified example of the conductive layers shown in FIG. 5.
Figure 8:
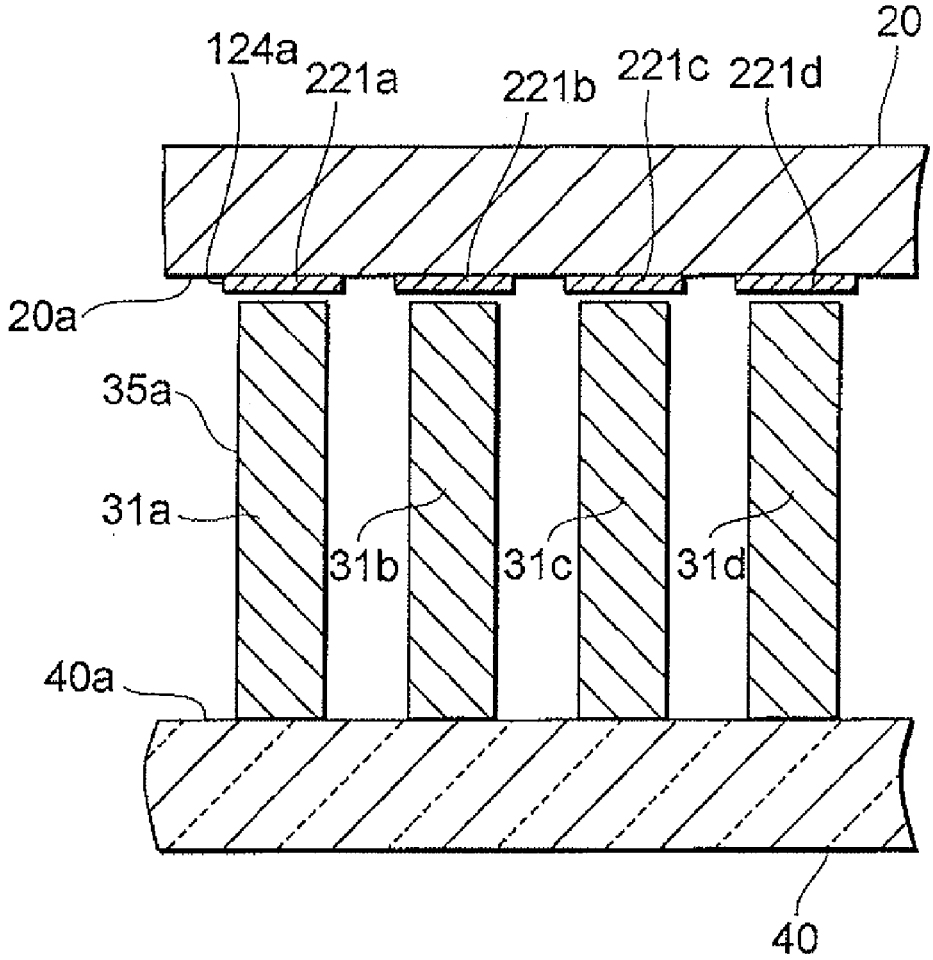
FIG. 8 is a partially enlarged sectional view showing a modified example of the conductive layers shown in FIG. 5.

For example, as shown in FIG. 7, the conductive layer 121*a* may be formed in such a manner that the end part 124*a* on the first end side in a direction at which electrons are multiplied is in alignment with a position of the end part 35*a* of the dynode 31*a* on the first end side. Further, as shown in FIG. 8, the conductive layer 221*a* may be formed in such a manner that the end part 124*a* on the first end side in a direction at which electrons are multiplied spreads to the first end side more than the end part 35*a* of the dynode 31*a* on the first end side. Accordingly, the conductive layer is reliably increased in area to prevent electric charge more efficiently. However, in view of keeping the withstand voltage between the conductive layers and preventing electric charge of the substrate at the same time, a configuration of conductive layers in FIG. 7 is preferable to that in FIG. 8. A configuration in which both end parts of the conductive layer deviate to a direction at which electrons are multiplied is more preferable to the configuration of the conductive layers in FIG. 7.

In addition, in the present embodiment, the photocathode 22 is a transmission-type photocathode but may be a reflection-type photocathode. Further, the anode 32 may be arranged between the dynode 31*i* and the dynode 31*j*.

What is claimed is:

1. A photomultiplier tube comprising:

a first substrate and a second substrate which are arranged so as to oppose each other, with the respective opposing surfaces made with an insulating material;

a side wall part which constitutes a casing together with the first and the second substrates;

a plurality of stages of electron multiplying parts which are arrayed on the opposing surface of the first substrate so as to be spaced away sequentially from a first end side to a second end side and each of which has a secondary electron surface formed on a column-like electrode part which is erected on the opposing surface of the first substrate;

a photocathode which is installed on the first end side so as to be spaced away from the electron multiplying part, thereby converting incident light from outside to photoelectrons to emit the photoelectrons; and an anode part which is installed on the second end side so as to be spaced away from the electron multiplying part to take out electrons multiplied by the electron multiplying part as a signal;

the photomultiplier tube, wherein the opposing surface of the second substrate is formed so as to cover the plurality of electron multiplying parts, and a plurality of conductive members which are electrically independent from each other and set equal in potential to the individually opposing electron multiplying parts are installed at sites opposing individually the plurality of electron multiplying parts on the opposing surface along the opposing surface of the second substrate, and wherein all of the stages of electron multiplying parts are fixed on the opposing surface of the first substrate at one end side, wherein all of the conductive members are formed on the opposing surface of the second substrate, wherein the height of the electron multiplying parts are larger than thickness of the conductive members, and wherein each another end side of the electron multiplying parts is positioned close to the opposing conductive member, and each of the electron multiplying parts is electrically-connected to the opposing conductive member.

2. The photomultiplier tube according to claim 1, wherein the plurality of conductive members are formed in such a manner that each of the end parts thereof on the second end side projects to the second end side more than each of the end parts of the opposing electron multiplying parts on the second end side.

3. The photomultiplier tube according to claim 1, wherein the plurality of conductive members are formed in such a manner that each of the end parts thereof on the first end side is positioned to the second end side more than each of the end parts of the opposing electron multiplying parts on the first end side.

4. The photomultiplier tube according to claim 1, wherein the plurality of conductive members are connected to a plurality of power feeding parts installed on the second substrate, and the plurality of electron multiplying parts are electrically connected to the individually opposing conductive members and thereby powered from the plurality of power feeding parts.

5. A photomultiplier tube according to claim 1, wherein the plurality of conductive members are provided one-to-one with a plurality of stages of electron multiplying parts.

6. A photomultiplier tube according to claim 5, wherein another conductive member is formed on the opposing surface of the second substrate at site opposing the photocathode.

7. A photomultiplier tube according to claim 6, wherein the photocathode is installed on the first substrate, and another conductive member is formed on the second substrate.

8. A photomultiplier tube according to claim 1, wherein each of the electron multiplying parts have a base part on which a column-like electrode part is fixed, and a column like conductor part which extend from the base part toward the opposing surface of the second substrate, another end side of the column like conductor part is positioned close to the opposing conductive member, and the column like conductor part is electrically-connected to the opposing conductive member.

9. A photomultiplier tube according to claim 8, wherein the column like conductor part is electrically-connected to the opposing conductive member via a conductive raised part which is installed on the opposing conductive member and project to another end side.

10. A photomultiplier tube comprising:

a first substrate and a second substrate which are arranged so as to oppose each other, with the respective opposing surfaces made with an insulating material;

a side wall part which constitutes a casing together with the first and the second substrates;

a plurality of stages of electron multiplying parts which are arrayed on the opposing surface of the first substrate so as to be spaced away sequentially from a first end side to a second end side and each of which has a secondary electron surface formed on a column-like electrode part which is erected on the opposing surface of the first substrate;

a photocathode which is installed on the first end side so as to be spaced away from the electron multiplying part, thereby converting incident light from outside to photoelectrons to emit the photoelectrons; and an anode part which is installed on the second end side so as to be spaced away from the electron multiplying part to take out electrons multiplied by the electron multiplying part as a signal;

the photomultiplier tube, wherein a plurality of power feeding parts are formed on a surface of the second substrate which opposes the opposing surface of the second substrate, a plurality of conductive terminals which are electrically-connected to the power feeding parts are formed on the opposing surface of the second substrate, and the electron multiplying parts are fixed on the opposing surface of the first substrate at one end side, and are electrically-connected to the conductive terminals at another end side.

11. A photomultiplier tube according to claim 10, wherein the anode parts are fixed on the opposing surface of the first substrate at one end side, and is electrically-connected to the conductive terminal at another end side.

12. A photomultiplier tube according to claim 10, wherein the first substrate is constituted with translucent material, and the photocathode is installed on the opposing surface of the first substrate.

13. A photomultiplier tube according to claim 10, wherein each of the electron multiplying parts have a base part on which a column-like electrode part is fixed, and a column like conductor part which extend from the base part toward the opposing surface of the second substrate, and the another end side of the column like conductor part is electrically-connected to the conductive terminal.

* * * * *